United States Patent [19]

Moen

[11] 4,317,357

[45] Mar. 2, 1982

[54] JET ORIFICE REDUCER

[76] Inventor: Jerry Moen, 4205 Flagstaff, Austin, Tex. 78758

[21] Appl. No.: 158,269

[22] Filed: Jun. 10, 1980

[51] Int. Cl.[3] ..... B21J 7/06

[52] U.S. Cl. ..... 72/438; 29/157 C; 72/404; 72/448

[58] Field of Search ..... 72/435, 436, 438, 437, 72/377, 404, 448, 447; 29/157 C; 239/546

[56] References Cited

U.S. PATENT DOCUMENTS

| | | | |
|---|---|---|---|
| 1,367,238 | 2/1921 | Coakley | 72/435 |
| 1,531,489 | 3/1925 | Macready | 72/435 |
| 1,635,945 | 7/1927 | Lewis | 72/334 |
| 1,752,141 | 3/1930 | Beche | 72/437 |
| 2,245,879 | 6/1941 | Sossner | 72/437 |
| 2,455,577 | 12/1948 | Hager | 72/436 |
| 2,641,941 | 6/1953 | Lundeberg | 72/436 |
| 3,150,442 | 9/1964 | Straw | 29/157 C |
| 3,359,773 | 12/1967 | Stuchbery | 72/436 |
| 3,641,802 | 2/1972 | Segro | 72/377 |
| 3,847,011 | 11/1974 | Errett | 29/157 C |

*Primary Examiner*—Gene P. Crosby

*Attorney, Agent, or Firm*—Roylance, Abrams, Berdo & Farley

[57] ABSTRACT

A tool for modifying openings in carburetor jets includes a base, upwardly extending guide rods, a relatively heavy tool-carrying block slidable on the rods, and a plate for holding the jet or jets to be modified. The plate has locating openings and the base has a locating pin, the locating openings being spaced so that when the proper one is placed on the pin the selected jet is accurately located beneath a tool carried by the block. The block, with the proper tool installed therein, is then lifted and allowed to drop so that the tool reduces the jet orifice size. The tools have rounded ends and diameters to properly modify various jets.

8 Claims, 5 Drawing Figures

JET ORIFICE REDUCER

This invention relates to an apparatus for modifying carburetor jets for combustion engines.

BACKGROUND OF THE INVENTION

It has been known for some time that the operating efficiency of an internal combustion engine can be improved by altering the size of the flow passage which admits fuel to the mixing chamber of a carburetor, thereby altering the fuel/air ratio. The optimum ratio is, in part, a function of the altitude at which the vehicle engine is being operated. Normally, engine manufacturers supply one jet type for "high" altitude operation and a different jet for "low" altitude operation but, these categories of high and low are rather broad, using, e.g., 6000 feet as a dividing line. Moreover, these categories are too broad in the sense that a change of a few hundred feet of altitude can make a meaningful difference in efficiency of engine operation.

For this reason, certain repair facilities have undertaken to reduce the size of the orifice in the standard jets, the effort being to make a rather small change to suit the engine needs. The manner in which this has been done, however, is relatively crude and involves placing a punch on the jet and manually striking it with a hammer or mallet. As would be expected, this manual technique results in off-center blows and blows which are too hard or not hard enough. Thus, calibration of the hole size is far from being precise, and jets are commonly ruined in a trial and error effort to arrive at the correct size.

Various devices have been developed in the past for adjusting the fuel delivery in an engine, and a number of machines are known for working metal, generally, and particularly for striking to enlarge or chamfer an opening. Examples of this prior art are found in the following U.S. patents:

U.S. Pat. No. 1,367,238, COAKLEY
U.S. Pat. No. 1,531,489, MACREADY ET AL.
U.S. Pat. No. 1,635,945, LEWIS ET AL.
U.S. Pat. No. 1,752,141, BECHE
U.S. Pat. No. 2,455,577, HAGER
U.S. Pat. No. 2,641,941, LUNDEBERG
U.S. Pat. No. 3,150,442, STRAW ET AL.
U.S. Pat. No. 3,641,802, SEGRO
U.S. Pat. No. 3,847,011, ERRETT

BRIEF SUMMARY OF THE INVENTION

An object of the present invention is to provide an apparatus for supporting a carburetor jet and for striking the jet orifice with a tool of predetermined size and shape, and with predetermined force, to accurately adjust the orifice size.

A further object is to provide such an apparatus having means for holding any one of a plurality of standard carburetor jets in a predetermined position and a gravity-operated tool carrier for striking the jet orifice with predetermined force to reduce the size therof.

Briefly described, the invention includes an apparatus for reducing the size of a fuel flow orifice through a jet or a carburetor comprising a base, at least one guide shaft mounted on the base and extending upwardly therefrom, a tool carrier having a predetermined mass, the tool carrier being slidably mounted on the shaft for movement toward or away from the base, and the tool carrier having means for fixedly supporting a selected one of a plurality of tools pointing toward a target location on the base, a plate having a plurality of openings for receiving a plurality of jets of different types, means on the base for selectively and accurately locating the plate in any one of plurality of positions corresponding to the number of jets such that, in each position, one of said jets is accurately held at the target location whereby, when the tool carrier is lifted away from the base and allowed to drop, the tool strikes the jet material surrounding the orifice therethrough and reduces the opening size thereof.

In order that the manner in which the foregoing and other objects are attained in accordance with the invention and understood in detail, particularly advantageous embodiments thereof will be described with reference to the accompanying drawings, which form a part of this specification, and wherein.

Figure 1:
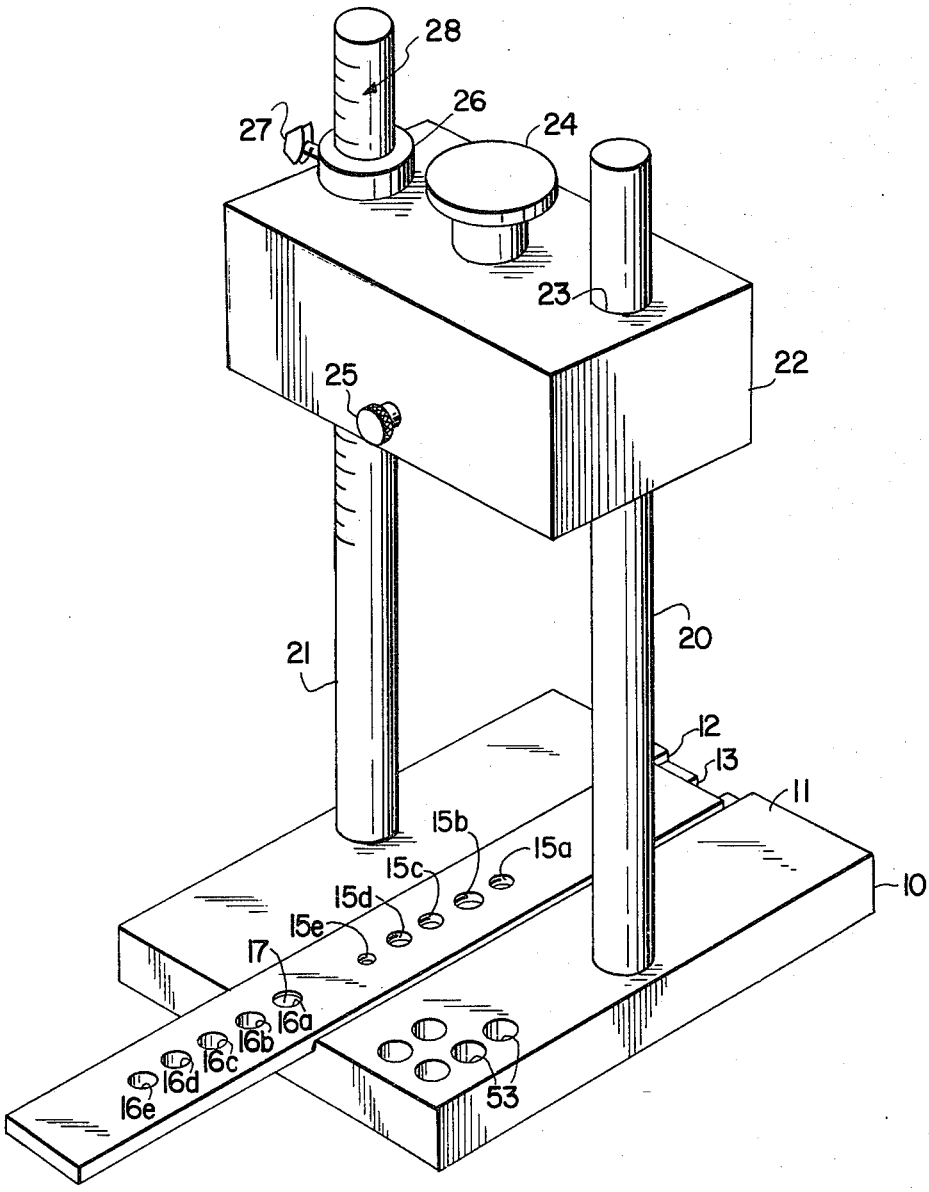
FIG. 1 is a perspective view of an apparatus in accordance with the invention.

As shown in FIG. 1, the apparatus includes a base 10 which is generally rectangular in shape, and which has an upper major surface 11. A recess 12 extends inwardly from face 11 and is elongated, preferably along a central axis of the base. Recess 12 receives a plate 14 which has a plurality of openings 15*a*–15*e* for receiving different types of carburetor jets. Openings 15*a–e* are internally threaded to firmly engage the jets which are externally threaded for installation in the carburetors for which they are designed.

Plate 14 also has a plurality of locating openings 16*a–e* which are dimensioned to receive a locating pin 17 which protrudes upwardly from the interior of recess 12 to firmly and accurately locate the position of plate 14.

In this connection, it will be observed that the spacing between holes 15*a*–15*e* is the same as the spacing between holes 16*a*–16*e* and that the distance between hole 15*a* and 16*a* is therefore exactly the same as the distance between holes 16*b* and 15*b*, etc. Thus, by placing the plate in recess 12 with pin 17 extending into one of the openings 16*a–e*, the related one of openings 15*a–e* is automatically positioned at a predetermined location on the base which will be referred to as a target location.

It will also be observed that the sides of recess 12 are parallel, the sides of plate 14 are parallel in a horizontal plane, and the plate and recess are dimensioned to fit snugly so that lateral motion therebetween is minimized.

The apparatus additionally includes first and second guide shafts 20 and 21 which are fixedly secured in base 1 and extend vertically upwardly therefrom. The previously mentioned target location preferably lies on a line between the centers of shafts 20 and 21. A tool carrier 22 comprises a heavy block which is provided with openings 23 to receive shafts 20 and 21 in a slinding relationship, the openings in tool carrier 22 being dimensioned to minimize any motion other than sliding motion in a direction parallel with the axis of shafts 20 and 21, which axes are parallel with each other. A knob 24 is fixedly attached to the top of carrier 22 to facilitate lifing thereof. A knurled locking screw 25 is provided in a front surfact of tool carrier 22 to hold a tool, as will be described.

A stop collar 26 is slidably and adjustably mounted on one of shafts 20 or 21, the stop collar being shown on shaft 21 in FIG. 1. The purpose of the stop collar is to limit the upward movement of tool carrier 22 and, therefore, to establish in a simple, repeatable fashion, the height from which the carrier will be permitted to drop. The position of the stop collar can be changed and established by the use of a thumb screw 27, the threaded shaft of which threadedly penetrates collar 26 and engages shaft 21. Shaft 21 is preferably provided with calibration indicia, indicated generally at 28, to permit determination of, and repetition of, precisely determined striking forces, as will become apparent from the discussion of the remaining figures.

Figure 2:
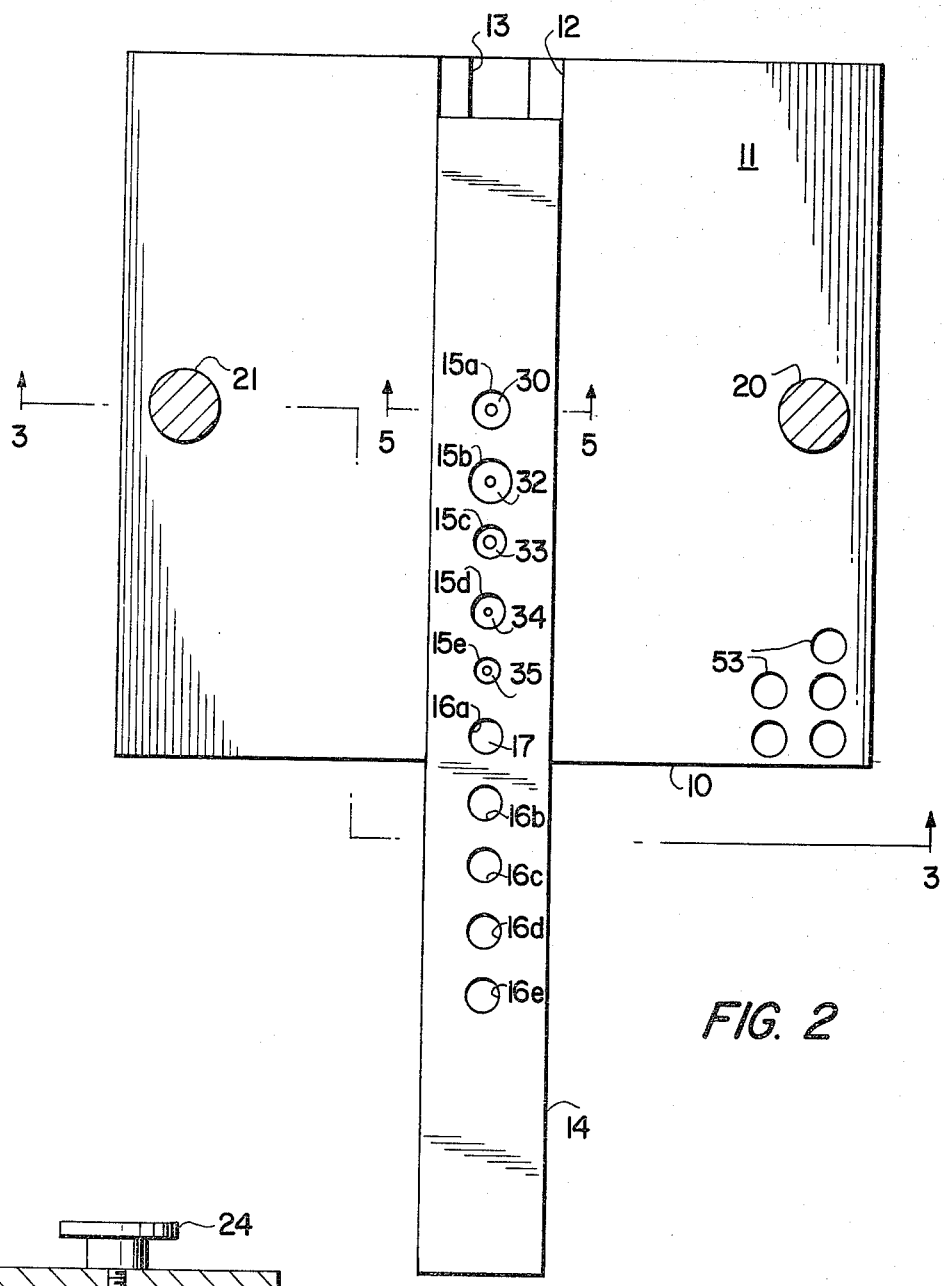
FIG. 2 is a plan view, in partial section, of the apparatus of FIG. 1.
Figure 3:
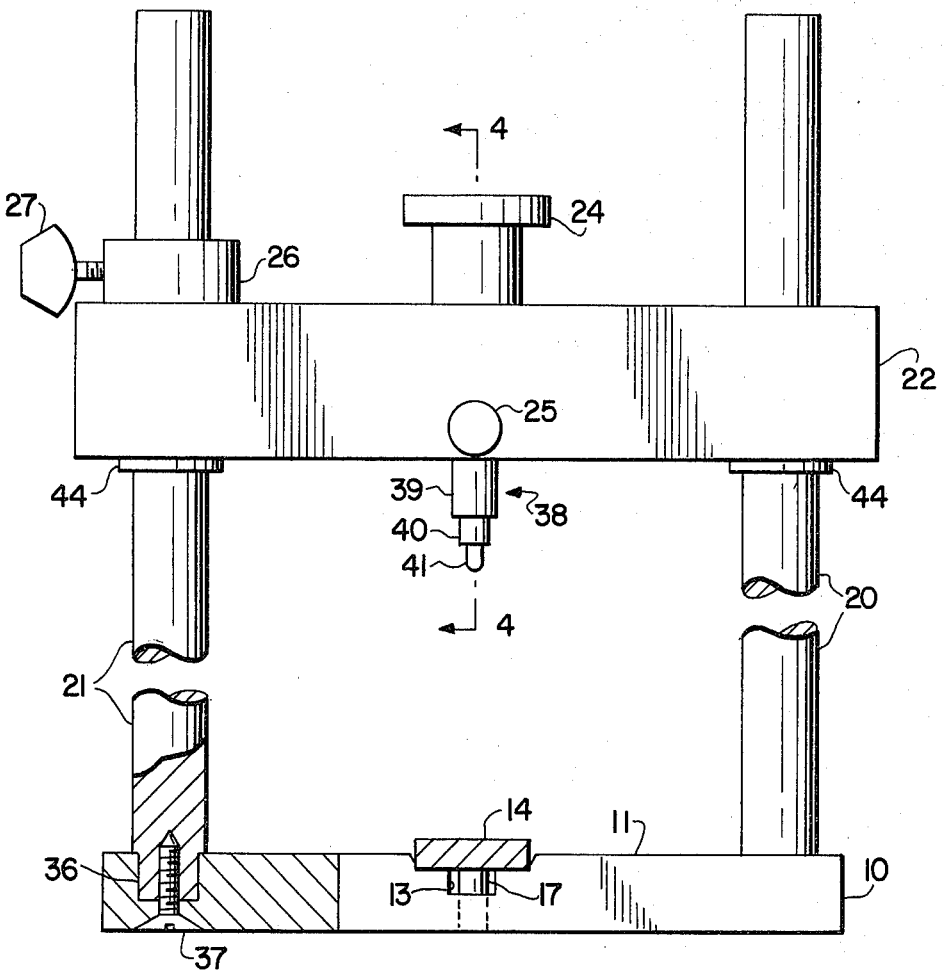
FIG. 3 is a front elevation, in partial section along line 3—3, of FIG. 2.

Turning now to FIGS. 2 and 3, it will be seen that opening 16a is shown placed over pin 17 so that opening 15a is aligned with the center line of plate 14 and, therefore, recess 12, and is also aligned with the centers of shafts 20 and 21, placing the jet held in opening 15*a* at the target area. This jet 30 is therefore in position to be acted on by the tool. Openings 15*b*–15*e* hold jets 31–35, any of which can be located at the target area by placing the plate so that pin 17 enters the respective one of opening 16*b*–*e*. It will be recognized, of course, that openings 15*a*–*e* will not necessarily all have jets therein, but that the specific type of jet being acted on will be placed in the appropriate opening of the plate and properly positioned as described.

It will also be observed from FIG. 2 that recess 12 has a central, deeper elongated recess 13 centrally located therein, forming horizontal shoulders to support plate 14 and a deeper section ro receive portions of jets 30–35, some of which are sufficiently large to protrude below the bottom surface of plate 14.

In FIG. 3, it will be seen that pin 17 is received in the portion of base 10 below recess 13, preferably by threading the exterior of the bottom portion of pin 17 and the interior of the opening in the base so that the pin is firmly held in position. Although it may not be apparent from FIG. 3, pin 17 and openings 16*a*–*e* are preferably tapered to match each other, thereby preventing inadvertent placement of plate 14 in an upside down position.

As will also be seen from FIG. 3, shafts 20 and 21 are held in base 10 by an arrangement which is shown in detail at the bottom of shaft 21, the lower end of the shaft being reduced in diameter as illustrated at 36 to be received in an opening in the base, the shaft being firmly seated therein by a screw 37 which protrudes upwardly through the bottom of the base and is threaded into the shaft. The tool 38 which is supported in tool carrier 22 is seen in FIG. 3 as including a relatively large diameter portion 39 which is received in an opening into the bottom of the tool carrier, a reduced diameter portion 40, and the operating end of the tool 41, the diameter of which is selected to be proper for the jet being adjusted. It will also be observed that the distal end of portion 41 is rounded so as to be substantially spherical. Preferably, the diameter of the portion 41 is between 1.1 and 2 times the inner diameter of the fuel flow orifice to be modified by that tool.

Figure 4:
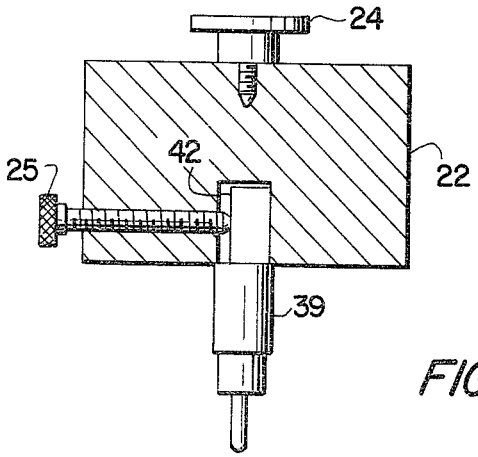
FIG. 4 is a vertical sectional view along line 4—4 of FIG. 3.

As best seen in FIG. 4, portion 39 is provided with a flat side 42 which is received within the opening in the bottom of tool carrier 22 and turned toward locking screw 25, the inner threaded end of which can then engage the flat surface 42 to lock to tool in place and prevent its rotation or displacement.

Also as seen in FIG. 3, the openings 23 through carrier 22 can be provided with bushings having enlarged annular end portions 44 which keep the block 22 spaced above the base and above the upper portion of plate 14, if the block is lowered without having a tool installed.

Figure 5:
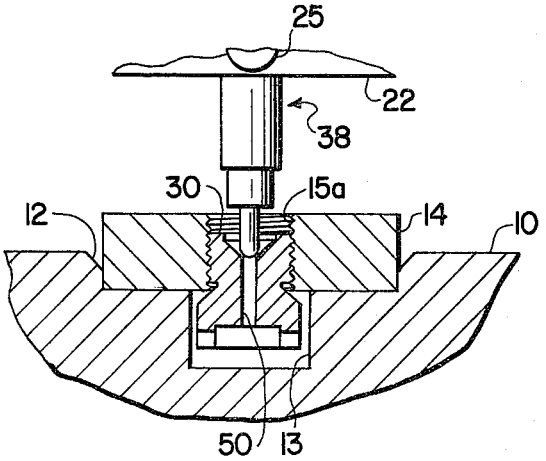
FIG. 5 is a fragmentary sectional view along line 5—5 of FIG. 2.

The relationship between plate 14, opening 15*a*, jet 30 and tool 38 is more clearly shown in the enlarged sectional view of FIG. 5. The specific type of jet shown by way of example includes a central orifice 50, the upper end of which is to be reduced in diameter. The external threads of the jet engage the internal threads of opening 15*a* to support the jet in fixed relationship with the plate, and the plate itself is accurately located as previously described so that orifice 50 is precisely located at the target area. Collar 26 is set at a predetermined height for operation on this particular jet, the height itself being determined by the mass of block 22 and the material of the jet, along with the amoung of modification of the jet which is necessary. The block 22 is then lifted and allowed to drop, causing the tool to contact the upper opening of orifice 50 as shown in FIG. 5, pressing the material surrounding that opening inwardly and downwardly and reducing the opening size.

In a specific embodiment of the apparatus, block 22 has a weight of approximately two pounds and the height from which that weight is dropped is roughly between four and nine inches, depending upon the altitude at which the jet is to be used and the material of that jet.

As a matter of convenience, base 10 can be provided with a plurality of holes 53 to accomodate tools 38 which are not being used, these tools having various diameter end portions for use with the various standard types of jets.

While one advantageous embodiment of the invention has been described in detail, it will be recognized by those familiar with this art that various changes and modifications can be made therein without departing from the scope of the appended claims.

What is claimed is:

1. An apparatus for reducing the size of a fuel flow orifice through a jet for a carburetor comprising a base;

at least one guide shaft mounted on said base and extending upwardly therefrom;

a tool carrier having a predetermined mass;

said tool carrier being slidably mounted on said at least one shaft for movement toward and away from said base, and said tool carrier having means for fixedly supporting a selected one of a plurality of tools pointing toward a target location on said base;

a plate having a plurality of openings for receiving a plurality of jets of different types;

means on said base for selectively and accurately locating said plate in any one of a plurality of positions corresponding to the number of jets such that, in each position, one of said jets is accurately held at said target location whereby, when said tool carrier is lifted away from said base and accelerated toward the base, said tool strikes the jet material surrounding the orifice therethrough and reduces the opening size thereof.

2. An apparatus according to claim 1 wherein said plate includes an elongated body having substantially parallel sides, said body having said plurality of openings for receiving said jets and a second plurality of locating openings, each of said first and second pluralities of openings being arranged along at least one line parallel with the longitudinal axis of said body, the spacing between said locating openings being the same as between said jet-receiving openings;

and wherein said means for locating said plate includes a locating pin protruding from said base, said pin being dimensioned to be received by any one of said locating openings.

3. An apparatus according to claim 2 wherein said base includes a major face which, in use, faces upwardly;

means defining an elongated recess extending inwardly from said major face, the bottom of said recess terminating in upwardly facing shoulders and having sufficient width to receive said plate; and means defining a longitudinal groove extending inwardly from the bottom of said recess, said pin being mounted in said groove.

4. An apparatus according to claim 3 wherein said at least one guide shaft comprises first and second elongated, cylindrical, parallel rods extending upwardly from said major face of said base from opposite sides of said recess.

5. An apparatus according to claim 4 wherein said tool carrier comprises a generally parallelepipedal block having openings therethrough to receive said first and second rods such that said block is slidable thereon toward and away from said base, said target area being defined by the intersection of a line between said rods and the central longitudinal axis of said recess.

6. An apparatus according to claim 1 and further comprising a plurality of tools equal in number to the number of jets receivable by said plate, each of said tools being adapted for use with one of the jet types, each of said tools have a striking end comprising a pinlike portion with a circular cross-section and a smoothly rounded end, the diameter of said pin-like portion being between about 1.1 and 2 times the inner diameter of the fuel flow orifice in the jet which that tool is adapted.

7. An apparatus according to claim 1 and further comprising a stop collar adjustably mounted on said shaft for limiting the distance said tool carrier can be lifted above said base.

8. An apparatus according to claim 7 including indicia on said shaft to permit accurate setting of the height from which said tool and tool carrier is dropped.

* * * * *